US005927080A

United States Patent [19]

Lee

[11] Patent Number: 5,927,080

[45] Date of Patent: Jul. 27, 1999

[54] VIBRATION-ACTUATED PUMP FOR A STIRLING-CYCLE REFRIGERATOR

[75] Inventor: Seok-Jin Lee, Suwon, Rep. of Korea

[73] Assignee: Samsung Electronics Co., Ltd., Suwon, Rep. of Korea

[21] Appl. No.: 09/018,340

[22] Filed: Feb. 4, 1998

[30] Foreign Application Priority Data

Apr. 7, 1997 [KR] Rep. of Korea ..... 1997-30911

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 5,284,022 2/1994 Chung ..... 62/6

5,463,868 11/1995 Peschka et al. ..... 62/6

5,609,034 3/1997 Mita et al. ..... 62/60

FOREIGN PATENT DOCUMENTS 5-126127 5/1993 Japan .

*Primary Examiner*—Ronald Capossela

*Attorney, Agent, or Firm*—Burns, Doane, Swecker & Mathis, L.L.P.

[57] ABSTRACT

A vibration-actuated pump is connected to a stirling-cycle refrigerator for absorbing the vibration generated when the stirling refrigerator is operated. The absorbed vibration is converted into a driving power for operating a pump to circulate a heat-transferring medium of a cooling circuit and/or a freezing circuit.

15 Claims, 6 Drawing Sheets

VIBRATION-ACTUATED PUMP FOR A STIRLING-CYCLE REFRIGERATOR

BACKGROUND OF THE INVENTION

1. Field of the Invention

The present invention relates to a stirling-cycle refrigerator (hereinafter a "stirling refrigerator"), and more particularly to a pump for circulating a heat-transferring medium.

2. Prior Art

In general, a stirling refrigerator is an appliance to produce refrigerating capacity by making a working fluid such as helium or hydrogen repeatedly experience two isothermal processes and two isochoric processes, and various types of stirling refrigerators have been introduced so far.

Japanese Patent Laid-Open No. 5-126427, published on May 21, 1993, discloses a conventional stirling refrigerator.

That conventional stirling refrigerator, as shown in FIG. 1, has a system 18' including a compression chamber 11', a first connecting tube 12', a radiator 13', a second connecting tube 14', a cold accumulator 15', a third connecting tube 16', and an expansion chamber 17'. The system 18' contains a working fluid and further includes a fluid-pressure-and-velocity-controller 29' for controlling the pressure and velocity of the working fluid.

The fluid-pressure-and-velocity-controller 29' includes a branch tube 26' one end of which is connected to the third connecting tube 16', an orifice 27' connected in series to the other end of the branch tube 26', and a backup tank 28'.

In the conventional stirling refrigerator described above, the fluid-pressure and-velocity-controller 29' of the system 18' is operated further efficiently in the range of ultra-low temperature and maintains the pressure and velocity difference of the working fluid nearly the same under an ultra-low temperature as under normal or low temperature. Therefore, the fluid-pressure-and-velocity-controller 29' enables an efficient operation of the stirling refrigerator even in the range of ultra-low temperature, thereby improving the refrigerating efficiency.

However, the conventional stirling refrigerator as described above has an disadvantage in that the driving devices 21, and 24', which are respectively installed at the compression chamber 11' and the expansion chamber 17', cause too much vibration and loud noise when they are operated, thereby diminishing the quality of the stirling refrigerator.

Further, the cold accumulator 15' and the radiator 13' respectively require a heat-transferring medium and pumping means for circulating the heat-transferring medium, thereby inevitably increasing the power consumption, as well as enlarging the refrigerator.

That is, the conventional stirling refrigerator has various problems in that the vibration and noise generated by the driving devices diminish the quality of the refrigerator, the power consumption is increased, and the size of the refrigerator is enlarged because separate pumping means for circulating heat transferring medium are required.

SUMMARY OF THE INVENTION

The present invention has been made to overcome the above described problems of the prior arts, and accordingly it is an object of the present invention to provide a vibration absorbing pump (and method) for a stirling refrigerator, which can improve the quality of a stirling refrigerator by utilizing the vibration generated when the stirling refrigerator is operated, to produce power for circulating a heat-transferring medium, thereby reducing the power consumption and minimizing the size of the refrigerator.

To achieve the above object, the present invention provides a stirling refrigerator, comprising a refrigerator body containing working fluid, and means for expanding and compressing the working fluid. That means comprises a motor disposed in the body, a piston disposed in the body and connected to the motor to be reciprocated thereby, and a displacer disposed in the body and arranged to be reciprocated therein in response to reciprocation of the piston. A heat exchanger is provided which includes a high temperature chamber communicating with the body for receiving working fluid therefrom, and a low temperature chamber communicating with the body for receiving working fluid therefrom. A cooling means is provided for circulating a first heat transfer medium into heat exchanging relationship with the high temperature chamber to absorb heat from the working fluid disposed therein. A freezing means is provided for circulating a second heat transfer medium into heat exchanging relationship with the low temperature chamber transfer heat to the working fluid disposed therein. A pumping means is provided which is connected to the body for converting vibration of the body into a force for circulating at least one of the first and second heat transfer media.

BRIEF DESCRIPTION OF THE DRAWINGS

The above object, and other features and advantages of the present invention will become more apparent by describing preferred embodiments thereof in detail with reference to the attached drawings, in which.

DESCRIPTION OF THE PREFERRED EMBODIMENTS

Hereinafter, several preferred embodiments of the present invention will be described in detail with reference to the accompanying drawings, and like elements will be numbered the same in the following description.

Figure 1:
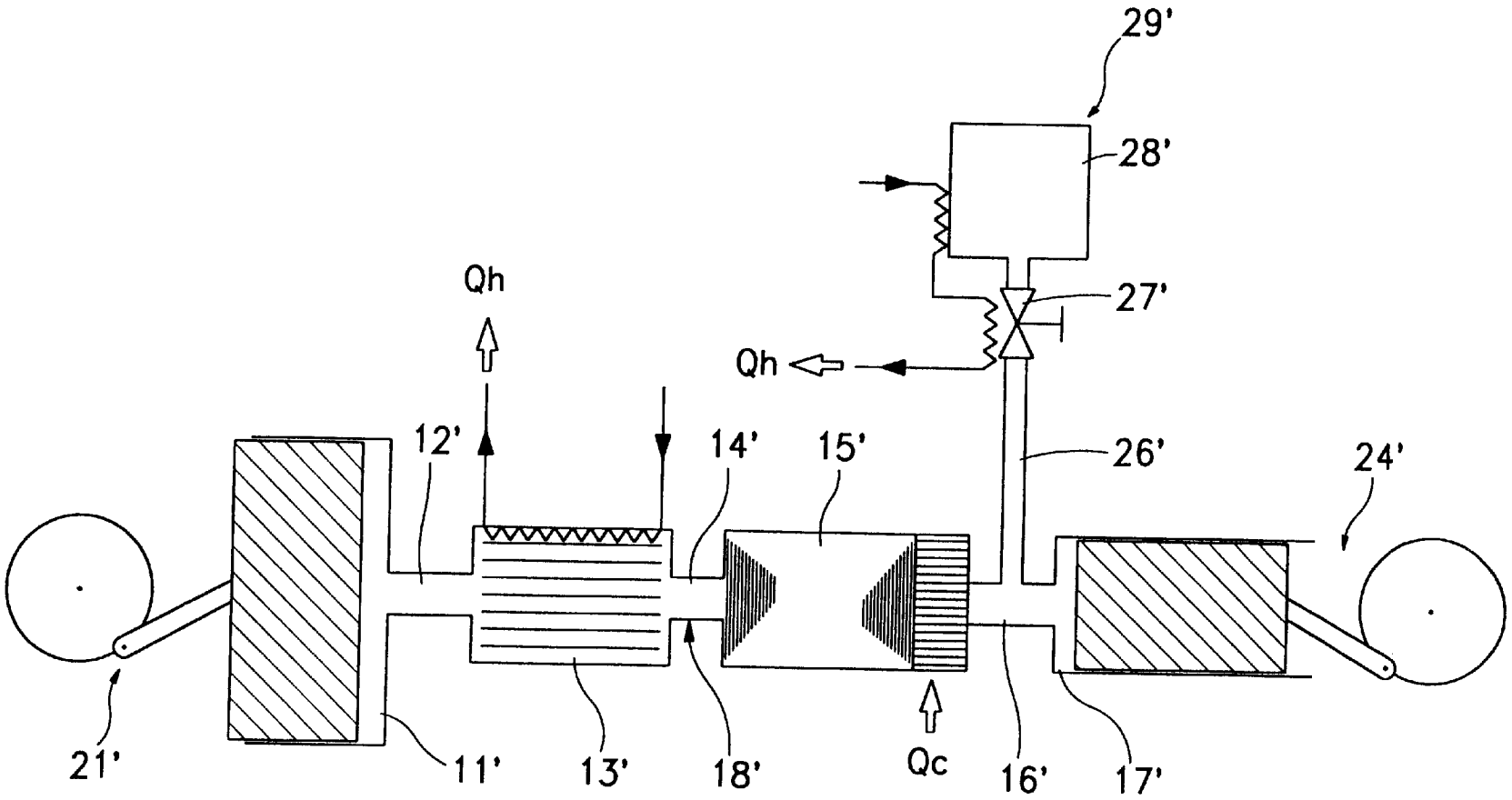
FIG. 1 (PRIOR ART)
FIG. 1 is a schematic diagram of a conventional stirling refrigerator.
Figure 2:
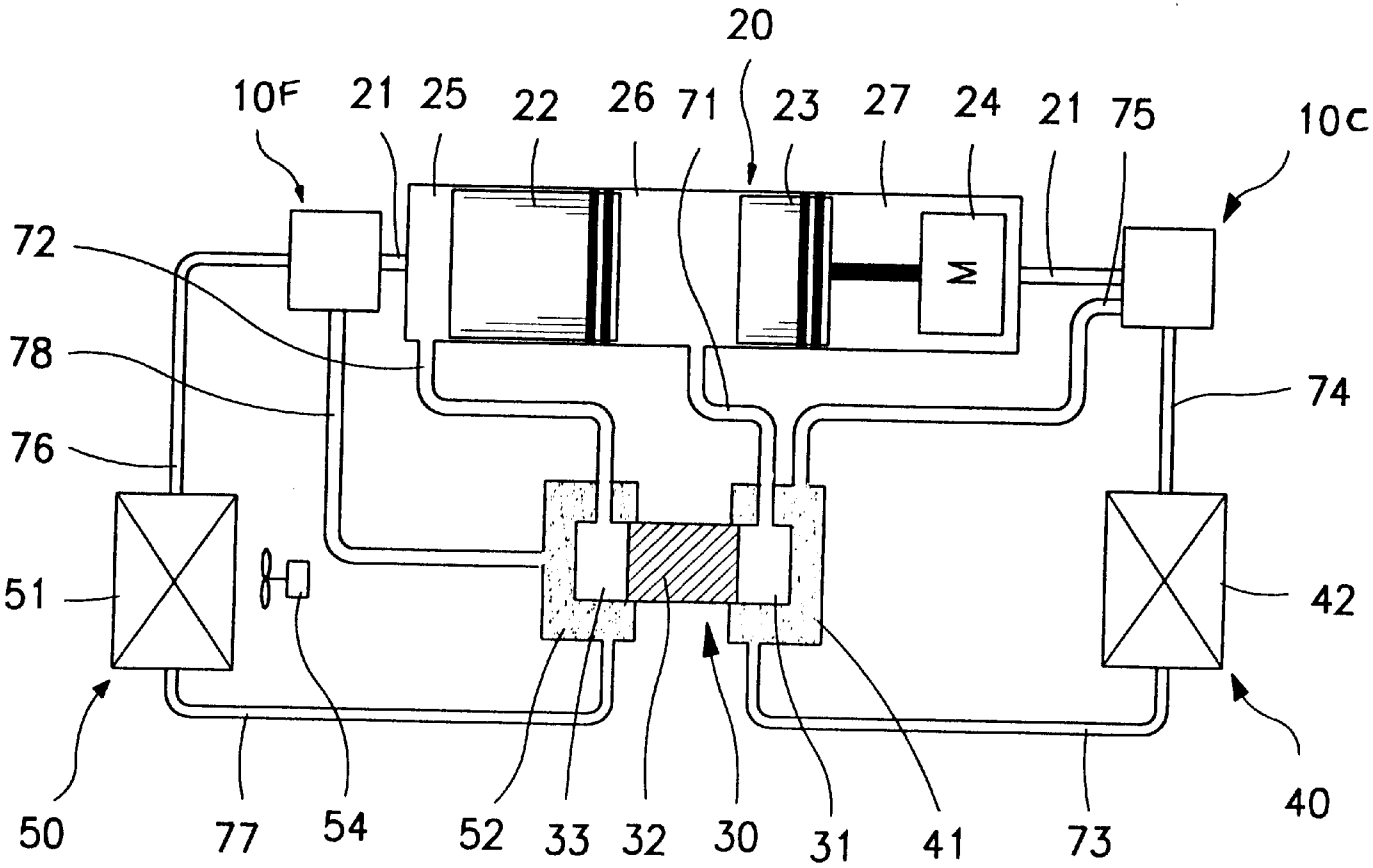
FIG. 2 is a schematic diagram of a first embodiment of a stirling refrigerator according to the present invention.
Figure 3:
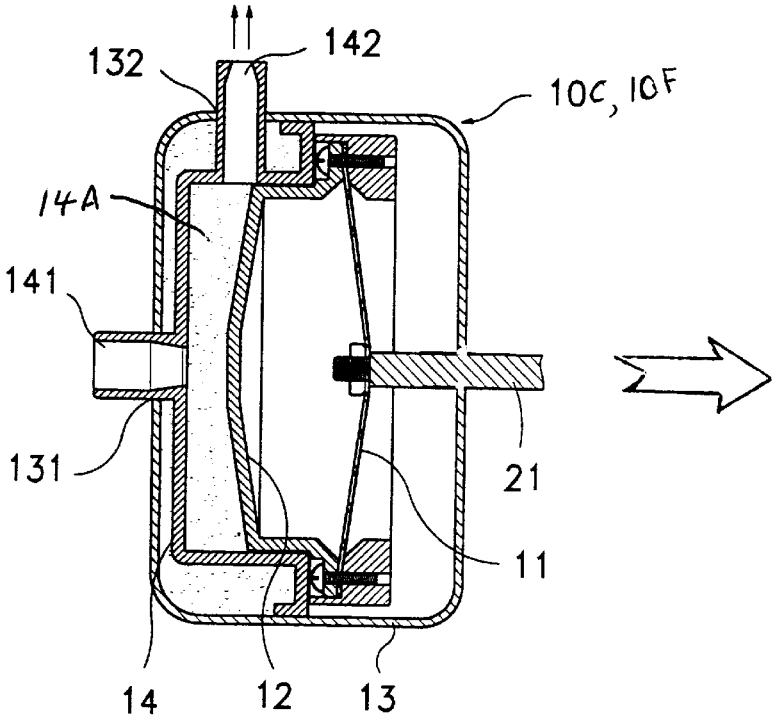
FIG. 3 is a sectional view of a first embodiment of a vibration-actuated pumping means when the volume of a pumping chamber is being decreased.
Figure 4:
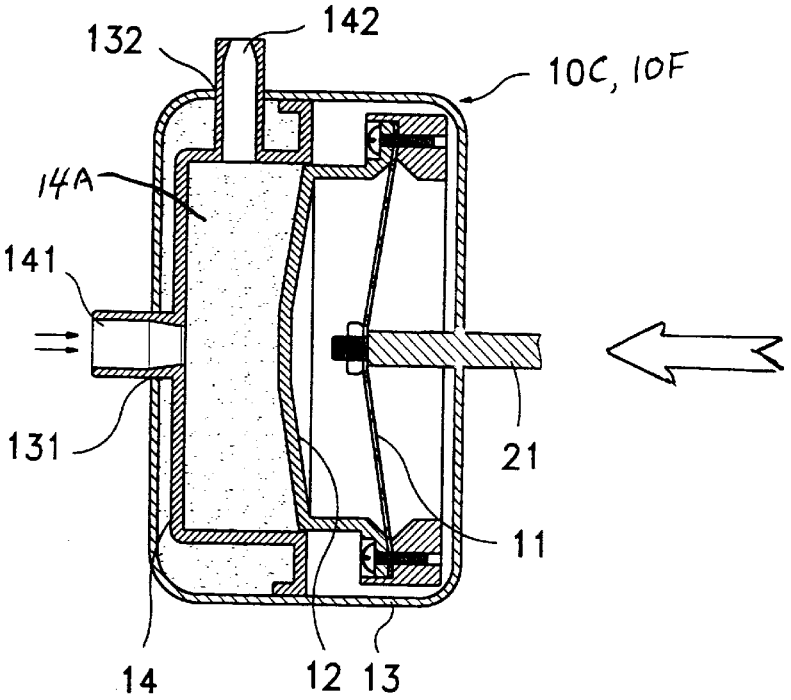
FIG. 4 is a sectional view of the pumping means shown in FIG. 3, when the volume in the pumping chamber is being increased.
Figure 5:
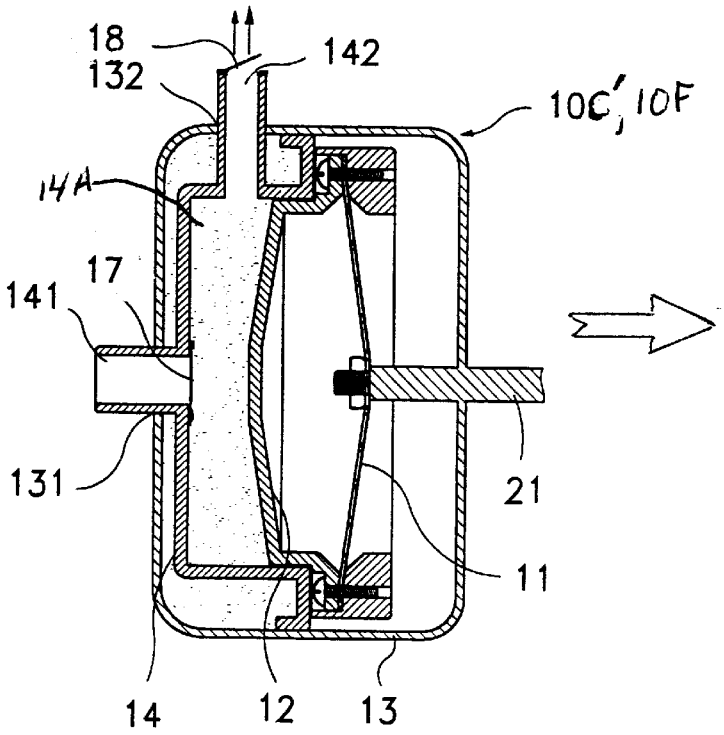
FIG. 5 is a sectional view of a second embodiment of a vibration-actuated pumping means according to the present invention, when the volume in the pumping chamber is being decreased.
Figure 6:
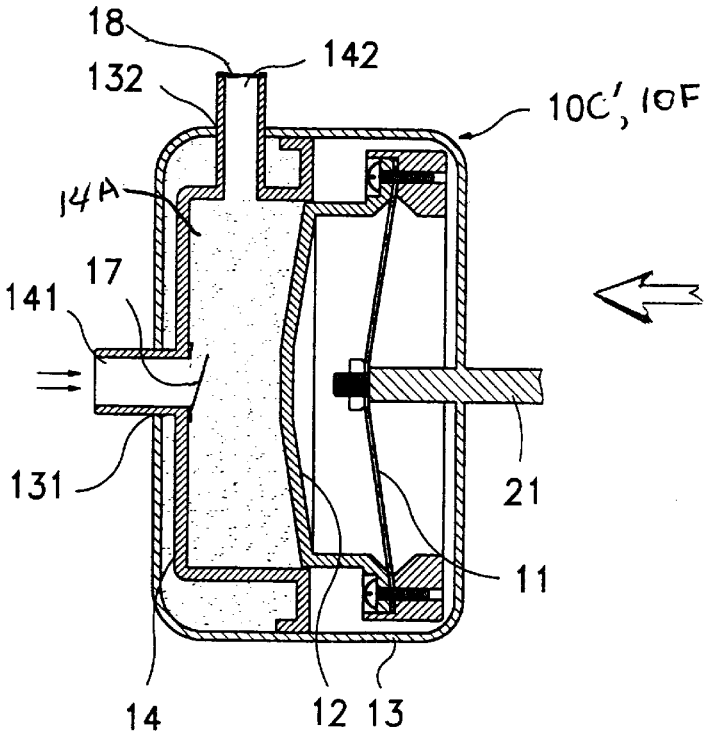
FIG. 6 is a sectional view of the pumping means shown in FIG. 5, when the volume in the pumping chamber is being increased.
Figure 7:
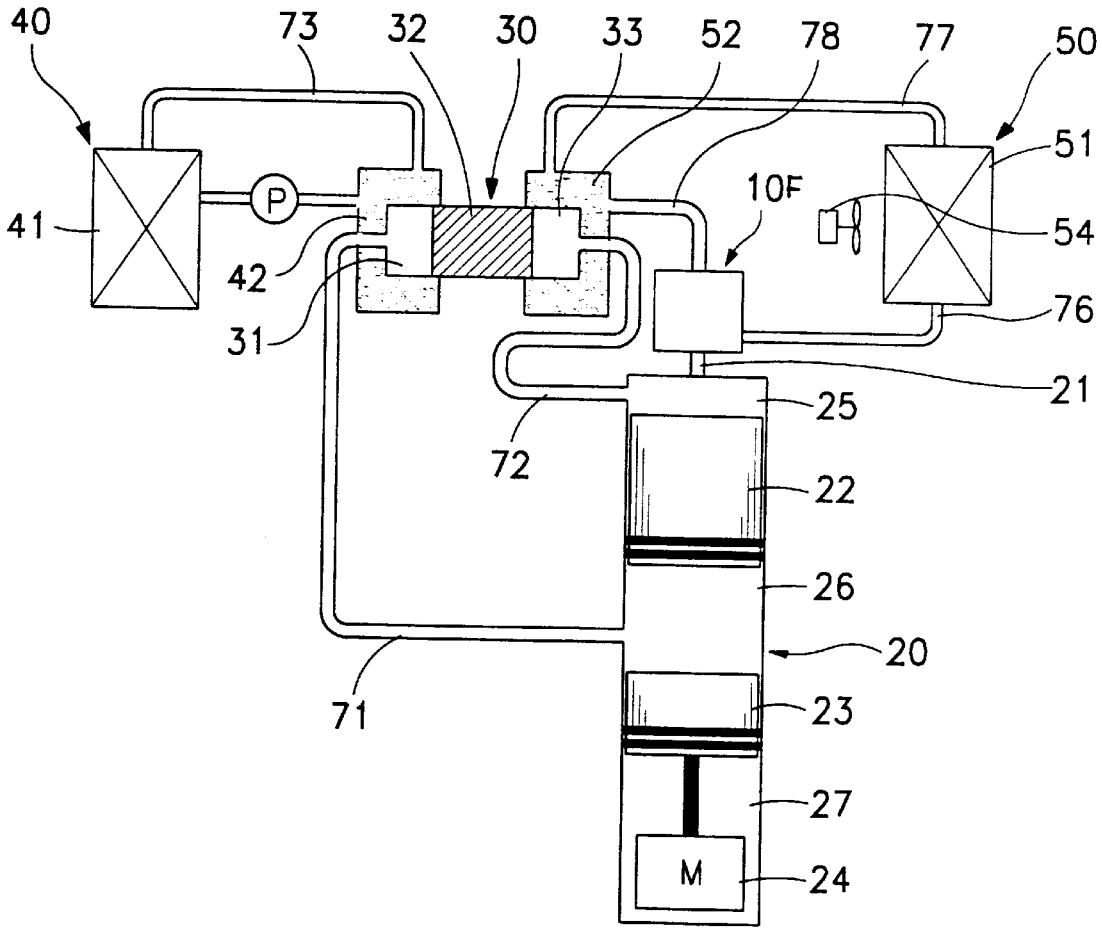
FIG. 7 is a schematic diagram of a second embodiment of a stirling refrigerator according to the present invention.
Figure 8:
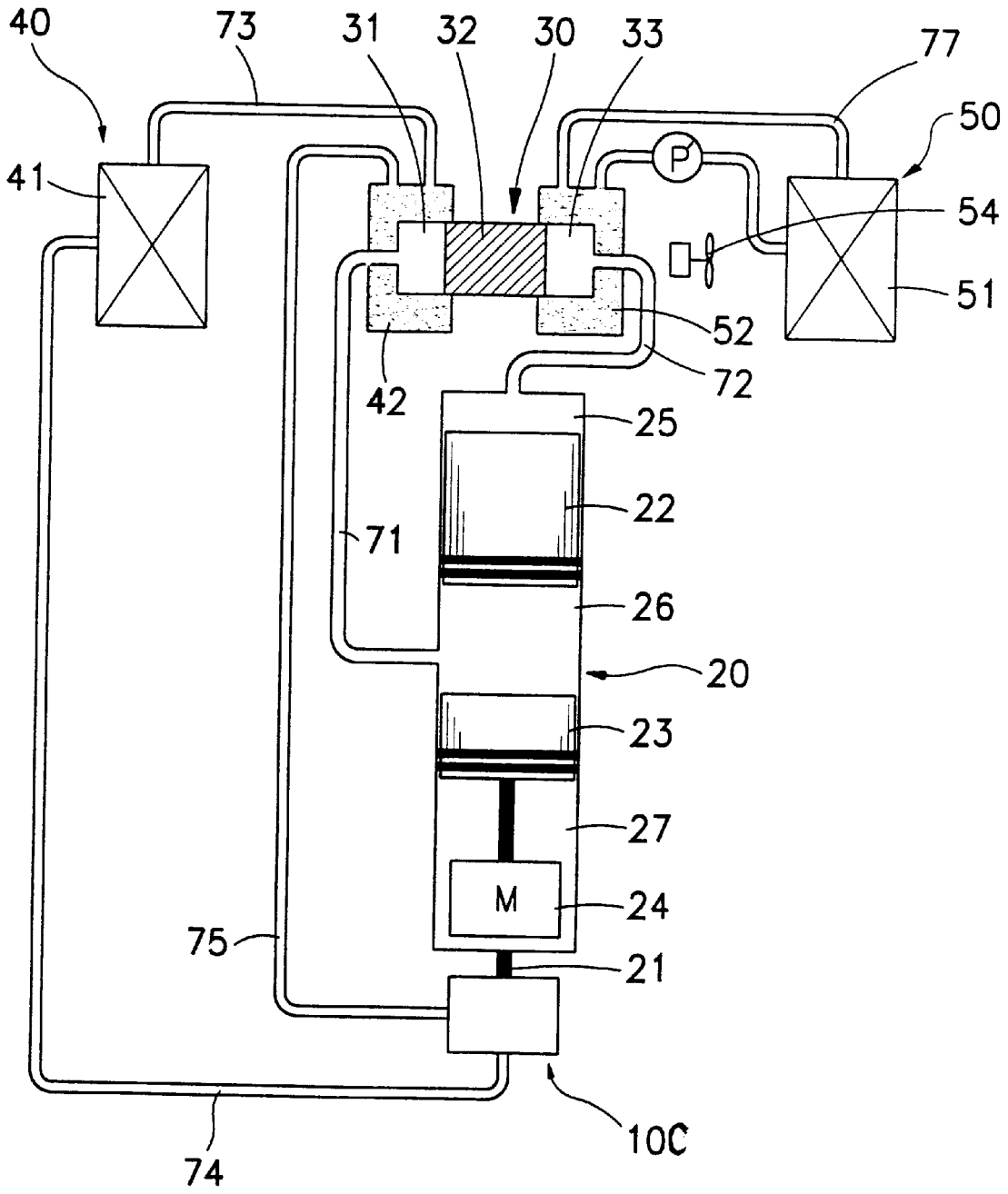
FIG. 8 is a schematic diagram of a third embodiment of a stirling refrigerator according to the present invention.

FIGS. 2, 7 and 8 are schematic views of first, second, and third embodiments, respectively, of a stirling-cycle refrigerator according to the present invention; FIGS. 3 and 4 are sectional views of a first embodiment of a vibration-absorbing-and-pumping means; and FIGS. 5 and 6 are sectional views of a second embodiment of a vibration-absorbing-and-pumping means.

Referring to FIG. 2, a body 20 of the stirling refrigerator contains a working fluid such as helium or hydrogen. The refrigerator body 20 includes a linear motor 24 for generating the driving power, a piston 23 reciprocating by means of the driving power generated from the linear motor 24, and a displacer 22 reciprocating with a predetermined phase lag with respect to the piston 23.

Further, an expansion chamber 25 is defined at one side of an interior of the refrigerator body 20 by the displacer 22, and a compression chamber 26 is defined at a middle portion of the interior of the refrigerator body 20 by the displacer 22 and piston 23, while a buffering chamber 27 is defined at the other side of the interior of the refrigerator body 20 in which the linear motor 24 is installed.

Meanwhile, a vibration transmitter rod 21 is fixed to each side of the refrigerator body 20. When the refrigerator body 20 vibrates due to the operation of the linear motor 24, the piston 23, and the displacer 22, the rods 21 follow the movement of the refrigerator body 20 to also vibrate. Each of the rods 21 is connected to a respective vibration-absorbing-and-pumping means 10C, 10F. The vibration-absorbing-and-pumping means 10C, 10F absorb and damp the vibration transferred from the refrigerator body 20 through the rods 21, and at the same time produce a driving power for circulating the heat transferring medium of a cooling means and a freezing means which will be described later.

In more detailed description with reference to FIGS. 3 and 4, the first embodiment of vibration-absorbing-and-pumping means 10C, 10F includes a casing 13, an elastic diaphragm member 11, a guide member 12, and a pumping member 14. The casing 13, which forms the outer appearance of the vibration-absorbing-and-pumping means is fixed to a respective rod 21. A first hole 131 and a second hole 132 extend through the casing 13. The elastic member 11 is assembled to one end of the rod 21 to absorb and damp the vibration transferred from the refrigerator body 20. The guide member 12 is connected to the elastic member 11. Therefore, the elastic member 11 absorbs and damps vibration produced by the movement of the elastic member 11.

The pumping member 14 is installed in, and is fixed to, the casing 13. The pumping member 14 is guided in reciprocation by the guide member 12 and forms a pumping chamber 14A together with the guide member 12. The pumping member produces a pumping force for circulating the heat transferring medium of a cooling means 40 or a freezing means 50, as will be explained in detail. An introduction tube 141 and an exhaust tube 142 are connected to the pumping member 14 and protrude outward therefrom. The exhaust tube 142 of the pumping member 14 is fitted in the second hole 132 of the casing 13, and the introduction tube 141 of the pumping member 14 is fitted in the first hole 131 of the casing 13.

The sectional area of a downstream end of an inlet passage formed by the introduction tube 141 is smaller than that of the upstream end thereof, so that the heat transferring medium of the cooling means 40 and freezing means 50 can be easily introduced into the pumping member 14. While on the other hand, the sectional area of a downstream end of an outlet passage formed by the exhaust tube 142 is larger than that of an upstream end thereof, so that the heat transferring medium of the cooling means 40 and freezing means 50 can be easily discharged out of the pumping member 14. The sectional area of the upstream end of the outlet passage is greater than that of the downstream end of the inlet passage.

Referring again to FIG. 2, reference numeral 30 designates a heat exchanging means for radiating or absorbing heat through compression or expansion of the working fluid contained in the refrigerator body 20. The heat-exchanging means 30 includes a high temperature chamber 31 for radiating heat through a compression of the working fluid, a low temperature chamber 33 for absorbing heat through an expansion of the working fluid, and a regenerator 32 arranged between the high temperature chamber 31 and the low temperature chamber 33 to accumulate the heat.

Moreover, the high temperature chamber 31 of the heat-exchanging means 30 is interconnected to the compression chamber 26 of the refrigerator body 20 through a first pipe 71 which guides the working fluid from the compression chamber 26 to the high temperature chamber 31 so that the working fluid can be compressed to radiate heat.

The low temperature chamber 33 of the heat-exchanging means 30 is interconnected to the expansion chamber 25 of the refrigerator body 20 through a second pipe 72 which guides the working fluid from the expansion chamber 25 to the low temperature chamber 33 so that the working fluid can be expanded to absorb heat.

In the meantime, reference numeral 40 designates a cooling means for cooling the heat radiated from the high temperature chamber 31. The cooling means 40 includes a heat absorbing member 41 and a high-temperature-heat-exchanging member 42. The heat absorbing member 41 surrounds the high temperature chamber 31 and is filled with heat transferring medium to absorb the heat radiated from the high temperature chamber 31, and the high-temperature-heat-exchanging member 42 radiates the heat absorbed by the heat transferring medium in the heat absorbing member 41.

The heat absorbing member 41 is interconnected to the high-temperature-heat-exchanging member 42 through a third pipe 73 which guides the heat transferring medium from the heat absorbing member 41 to the high-temperature-heat-exchanging member 42 so that the heat transferring medium heated to high temperature can be cooled in the high-temperature-heat-exchanging member 42.

Further, the vibration-absorbing-and-pumping means 10C is interconnected to the high-temperature-heat-exchanging member 42 through a fourth pipe 74 and to the heat absorbing member 41 through a fifth pipe 75, so that the heat transferring medium of the cooling means 40 can be circulated by the driving force of the vibration-absorbing-and-pumping means 10C.

That is, the fourth pipe 74 of the cooling means 40 is connected to the introduction tube 141 of the vibration-absorbing-and-pumping means 10C, and the fifth pipe 75 of the cooling means 40 is connected to the exhaust tube 142 of the vibration-absorbing-and-pumping means 10C. Therefore, the pumping force of the vibration-absorbing-and-pumping means 10C generated by the absorbed vibration from the refrigerator body 20 enables the heat transferring medium of the cooling means 40 to circulate between the heat absorbing member 41 and the high-temperature-heat-exchanging member 42 of the cooling means 40.

Reference numeral 50 designates a freezing means for producing a freezing effect. The freezing means 50 includes a radiator 52, a low-temperature-heat-exchanging member 51, and a fan 54. The radiator 52 surrounds the low temperature chamber 33 and is filled with the heat transferring medium so as to radiate heat into the low temperature chamber 33. The low-temperature-heat-exchanging member 51 produces the freezing effect by means of the heat transferring medium cooled after radiating heat into the low temperature chamber 33. The fan 54 blows the heat removed from the transferring medium traveling the low-temperature-heat-exchanging member 51, to a required region.

The low-temperature-heat-exchanging member 51 of the freezing means 50 is interconnected to the radiator 52 through a seventh pipe 77 which guides the heat transferring medium from the low-temperature-heat-exchanging member 51 to the radiator 52. Further, the vibration-absorbing-and-pumping means 10F is interconnected to the low-temperature-heat-exchanging member 51 through a sixth pipe 76 and to the radiator 52 through an eighth pipe 78, so that the heat transferring medium of the freezing means 50 can be circulated by the driving force of the vibration-absorbing-and-pumping means 10F.

That is, the eighth pipe 78 of the freezing means 50 is connected to the introduction tube 141 of the vibration-absorbing-and-pumping means 10F, and the sixth pipe 76 of the freezing means 50 is connected to the exhaust tube 142 of the vibration-absorbing-and-pumping means 10F. Therefore, the pumping force of the vibration-absorbing-and-pumping means 10F generated by the absorbed vibration from the refrigerator body 20 enables the heat transferring medium of the freezing means 50 to circulate to the low-temperature-heat-exchanging member 51 from the radiator 52 of the freezing means 50.

Hereinafter, the operation of the vibration-absorbing-and-pumping means of the stirling refrigerator constructed according to the present invention will be described.

First, when the stirling refrigerator is operated, an electric power is applied to the linear motor 24, which produces the driving power. Then, the piston 23 and the displacer 22 respectively reciprocate with a predetermined phase lag therebetween while being guided in the refrigerator body 20 by the driving power of the linear motor 24.

Since the piston 23 and the displacer 22 respectively reciprocate with a predetermined phase lag therebetween by the driving power of the linear motor 24, the volumes of the expansion chamber 25 and the compression chamber 26 defined in the refrigerator body 20 change, and thereby the volumetric change of the expansion chamber 25 and the compression chamber 26 enables the working fluid contained therein to be compressed and expanded.

In addition, the working fluid in the expansion chamber 25 is supplied into the low temperature chamber 33, and then expanded to cool the heat transferring medium filled in the radiator 52 of the freezing means 50 by absorbing heat therefrom. The heat transferring medium cooled in the radiator 52 is supplied into the low-temperature-heat-exchanging member 51 to produce the freezing effect.

Meanwhile, the working fluid in the compression chamber 26 of the refrigerator body 20 is supplied into the high temperature chamber 31, and then compressed to radiate heat to the heat transferring medium filled in the heat absorbing member 41 of the cooling means 40. The heat transferring medium heated to high temperature by the heat radiated from the high temperature chamber 31 is cooled in the high-temperature-heat-exchanging member 42.

In the meantime, while the piston 23 and the displacer 22 are respectively reciprocating with a predetermined phase lag between them, several internal parts including the linear motor 24, the displacer 22, and the piston 23 cause vibration which make the rods 21 vibrate.

The vibration generated in the rods 21 is absorbed by the vibration-absorbing-and-pumping means 10C, 10F which produces a driving force for circulating respectively the heat transferring medium of the freezing means 50 and the cooling means 40 by means of the absorption of the vibration.

As a result, the vibration generated in the refrigerator body 20 is absorbed and damped, whereby there is provided an improved stirling refrigerator of high quality, in which vibration and noise are greatly reduced or eliminated.

The above described stirling refrigerator has a further advantage, in that the heat transferring medium of the cooling means 40 and the freezing means 50 can be circulated without the need for an additional power supplier because the vibration absorbed in the vibration-absorbing-and-pumping means 10C, 10F generates the driving force.

That is, the volume of the pumping chamber 14A is changed according to the reciprocation of the pumping member 14, to circulate the heat transferring medium of the cooling means 40 or the freezing means 50.

In operation, the rod 21 is vibrated during operation of the refrigerator body 20 and thus reciprocates in the right-hand and left-hand directions as shown in FIGS. 3 and 4, respectively. The rod 21, casing 13 and the pumping member 14 are all fixedly connected together, so they reciprocate together as a unit. That reciprocation of the unit 21, 13, 14 occurs relative to the guide member 12 which, due to its mass of inertia, remains essentially stationary, especially since the elastic diaphragm member 11 absorbs most of the reciprocating motion of the rod 21 before it reaches the guide member 12.

When the unit 21, 13, 14 moves to the right (FIG. 3), the volume of the pumping chamber 14A is reduced (and its internal pressure is increased), causing the heat transferring medium therein to be transferred through the exhaust tube 142, since the inlet (bottom end) of the exhaust tube is of greater cross sectional area than the outlet (right-hand end) of the introduction tube 141.

While on the other hand, when the unit 21, 13, 14 moves to the left, as shown in FIG. 4, the volume in the pumping chamber 14A is increased (and the internal pressure therein is decreased). Then, the heat transferring medium of the cooling means 40 or the freezing means 50 is introduced through the introduction tube 141 into the pumping chamber 14A.

Therefore, the heat transferring medium of the cooling means 40 and the freezing means 50 can be circulated by the vibration generated in the refrigerator body 20 without requiring a separate power supplier, thereby greatly reducing the power consumption.

Hereinbelow, the second embodiment of a vibration-absorbing-and-pumping means 10C', 10F' will be described with reference to FIGS. 5 and 6, wherein the same elements as in FIGS. 3 and 4 are given the same reference numerals.

The vibration-absorbing-and-pumping means 10C', 10F' shown in FIGS. 5 and 6 is similar to that of FIGS. 3 and 4, except that the sectional areas of the introduction tube 141 and the exhaust tube 142 are constant, and a first valve 17 and a second valve 18 are respectively disposed at the introduction tube 141 and the exhaust tube 142, respectively, so as to open and close them.

In other words, as shown in FIG. 5, unit 21, 13, 14 moves to the right so that the volume in the pumping chamber 14A is decreased, the first valve 17 closes the introduction tube 141 and at the same time the second valve 18 opens the exhaust tube 142. Thus, the heat transferring medium is discharged through the exhaust tube 142.

On the other hand, as shown in FIG. 6, when the unit 21, 13, 14 moves to the left, so that the volume in the pumping member 14 is increased, the first valve 17 opens the introduction tube 141 and at the same time the second valve 18 closes the exhaust tube 142.

Next, a brief description of the second embodiment of a stirling refrigerator according to the present invention will be given below, with reference to FIG. 7, which is a schematic diagram of the stirling refrigerator.

The stirling refrigerator according to the second embodiment of the present invention is similar to that according to the first embodiment, so the same elements are given the same reference numerals. In FIG. 7 the difference is that the heat transferring medium circulating in the cooling means 40 is transferred by a pumping means P and the heat transferring medium circulating in the freezing means 50 is transferred by the vibration-absorbing-and-pumping means 10F.

Next, a brief description of the third embodiment of the sterling refrigerator according to the present invention will be given below, with reference to FIG. 8, which is a schematic diagram of the stirling refrigerator.

The third embodiment of the present invention is similar to the first embodiment, so the same elements are given the same reference numerals. In FIG. 8, the difference is that the heat transferring medium circulating in the freezing means 50 is transferred by a pumping means P' and the heat transferring medium circulating in the cooling means 40 is transferred by the vibration-absorbing-and-pumping means 10C.

As described above, during operation of the vibration-absorbing-and-pumping means of the stirling refrigerator according to the present invention, the vibration generated is absorbed and damped to provide a Stirling refrigerator having a high quality. In addition, the present invention provides a stirling refrigerator with greatly reduced power consumption and greatly reduced size, because the heat transferring medium of the cooling means and the freezing means is circulated by the driving force which is produced by the vibration generated in the stirling refrigerator.

While the present invention has been particularly shown and described with reference to the particular embodiments thereof, it will be understood by those skilled in the art that various changes in form and details may be effected therein without departing from the spirit and scope of the invention as defined by the appended claims.

I claim:

1. A stirling-cycle refrigerator comprising:

a refrigerator body containing working fluid;

means for expanding and compressing the working fluid, comprising:

a motor disposed in the body, a piston disposed in the body and connected to the motor to be reciprocated thereby; and a displacer disposed in the body and arranged to be reciprocated therein in response to reciprocation of the piston;

a heat exchanger including a high temperature chamber communicating with the body for receiving working fluid therefrom, and a low temperature chamber communicating with the body for receiving working fluid therefrom;

a cooling means for circulating a first heat transfer medium into heat exchanging relationship with the high temperature chamber for absorbing heat from the working fluid disposed therein;

freezing means for circulating a second heat transfer medium into heat exchanging relationship with the low temperature chamber for transferring heat to the working fluid disposed therein; and pumping means connected to the body for converting vibration of the body into a force for circulating at least one of the first and second heat transfer media.

2. The refrigerator according to claim 1 wherein the at least one of the first and second heat transfer media comprises the first heat transfer medium.

3. The refrigerator according to claim 1 wherein the at least one of the first and second heat transfer media comprises the second heat transfer medium.

4. The refrigerator according to claim 1 wherein the pumping means circulates both of the first and second heat transfer media.

5. A stirling-cycle refrigerator comprising:

a refrigerator body containing working fluid;

means for expanding and compressing the working fluid, comprising:

a motor disposed in the body, a piston disposed in the body and connected to the motor to be reciprocated thereby; and a displacer disposed in the body and arranged to be reciprocated therein in response to reciprocation of the piston;

a heat exchanger including a high temperature chamber communicating with the body for receiving working fluid therefrom, and a low temperature chamber communicating with the body for receiving working fluid therefrom;

a cooling means for circulating a first heat transfer medium into heat exchanging relationship with the high temperature chamber for absorbing heat from the working fluid disposed therein;

freezing means for circulating a second heat transfer medium into heat exchanging relationship with the low temperature chamber for transferring heat to the working fluid disposed therein; and a pumping assembly including first and second members forming a pumping chamber therebetween for containing the at least one heat transfer medium, the pumping chamber having inlet and outlet passages, the first and second structures being relatively reciprocable to alternately increase and decrease the volume of the pumping chamber, the first structure being connected to the body to be vibrated thereby to produce the relative reciprocation between the first and second structures.

6. The refrigerator according to claim 5 wherein the second structure is disposed inside of the first structure and is connected to the first structure by an elastic element for isolating the second structure from vibrations of the body.

7. The refrigerator according to claim 6 wherein the elastic element comprises an elastic diaphragm, the first structure connected to a center region of the diaphragm, and the second structure connected to an outer peripheral region of the diaphragm.

8. The refrigerator according to claim 6, wherein the second structure guides the first structure during reciprocation of the first structure.

9. The refrigerator according to claim 5 wherein the first structure forms the inlet passage for introducing the at least one heat transfer medium into the pumping chamber, and the outlet passage for discharging the at least one heat transfer medium from the pumping chamber.

10. The refrigerator according to claim 9 wherein a downstream end of the outlet passage is of smaller cross-section than an upstream end thereof; a downstream end of the inlet passage being of smaller cross section than an upstream end thereof and being of smaller cross section than the upstream end of the outlet passage.

11. The refrigerator according to claim 9, further including flap valves at the outlet and inlet passages respectively, for closing the inlet passage and opening the outlet passage when the pumping chamber is being compressed, and for opening the inlet passage and closing the outlet passage when the pumping chamber is being expanded.

12. The refrigerator according to claim 5 wherein the second structure comprises: a rod attached to the body for transmitting vibrations therefrom, a casing fixedly connected to the rod and forming a space in which the second structure is disposed, and a pumping member forming the pumping chamber together with the second structure.

13. The refrigerator according to claim 5 wherein the at least one of the first and second heat transfer media comprises the first heat transfer medium.

14. The refrigerator according to claim 5 wherein the at least one of the first and second heat transfer media comprises the second heat transfer medium.

15. The refrigerator according to claim 5 wherein the pumping means circulates both of the first and second heat transfer media, the pumping assembly constituting a first pumping assembly for circulating the first heat transfer medium; the refrigerator further comprising a second said pumping assembly for circulating the second heat transfer medium.

* * * * *